US009585487B1

(12) United States Patent
Brown et al.

(10) Patent No.: US 9,585,487 B1
(45) Date of Patent: Mar. 7, 2017

(54) RELAXATION DEVICE AND METHOD OF USE

(71) Applicant: Gait, LLC, Granger, IN (US)

(72) Inventors: Marilyn I. Brown, South Bend, IN (US); Harriet Y. Phillips, Granger, IN (US); Scott A. Albright, Buchanan, MI (US); Justin D. Erickson, Stevensville, MI (US); Robert K. Blake, Three Oaks, MI (US)

(73) Assignee: Gait, LLC, Granger, IN (US)

( * ) Notice: Subject to any disclaimer, the term of this patent is extended or adjusted under 35 U.S.C. 154(b) by 0 days.

(21) Appl. No.: 14/615,895

(22) Filed: Feb. 6, 2015

(51) Int. Cl.
*A47C 1/00* (2006.01)
*A47C 9/00* (2006.01)
*A61G 5/10* (2006.01)

(52) U.S. Cl.
CPC ..... *A47C 9/002* (2013.01); *A61G 5/1056* (2013.01); *A61G 5/1059* (2013.01)

(58) Field of Classification Search
CPC ..... A47C 9/002; A61G 5/1056; A61G 5/1059
USPC ..... 297/311, 344.12, 344.17, 344.1, 258.1, 297/260.2; 472/97; 434/247; 482/51
See application file for complete search history.

(56) References Cited

U.S. PATENT DOCUMENTS 6,616,456 B1 * 9/2003 Nalty ..... A63B 26/003 434/247
7,104,927 B2 * 9/2006 Tsai ..... A63B 69/04 472/95
7,121,831 B2 * 10/2006 Hojo ..... A63B 69/04 434/247
7,608,017 B2 * 10/2009 Nakanishi ..... A63B 69/04 434/51
7,775,939 B2 * 8/2010 Nakanishi ..... A61H 1/001 434/247
7,931,565 B2 * 4/2011 Nakano ..... A63B 69/04 434/247
8,523,214 B2 * 9/2013 Johansson ..... A61G 5/10 280/304.1
8,852,010 B2 * 10/2014 Garner ..... A63G 19/20 434/247
2002/0115536 A1 * 8/2002 Hojo ..... A63B 26/003 482/51
2008/0252116 A1 * 10/2008 Phillips ..... A61H 1/003 297/217.1
2009/0075783 A1 * 3/2009 Nakanishi ..... A63B 26/003 482/51

(Continued)

OTHER PUBLICATIONS

Panasonic, "Operating Instructions Core Trainer Exercise Equipment Model EU7805", at least as early as Nov. 6, 2013, 23 pages.

(Continued)

*Primary Examiner* — Laurie K Cranmer
(74) *Attorney, Agent, or Firm* — Barnes & Thornburg LLP

(57) ABSTRACT

A relaxation device includes a base, a support structure connected to the base, a seating portion and a drive mechanism. The drive mechanism is coupled to the seating portion and moves the seating portion in a manner replicating the gate of a walking horse. Persons with autism spectrum disorders and other conditions may utilize the device as a method of relaxation to lessen certain behaviors and characteristics associated with such conditions.

11 Claims, 12 Drawing Sheets

(56) References Cited

U.S. PATENT DOCUMENTS

| | | | | |
|---|---|---|---|---|
| 2010/0125024 | A1* | 5/2010 | Nakano | A63B 22/16 482/4 |
| 2010/0181815 | A1* | 7/2010 | Highlander | A47C 7/14 297/313 |
| 2015/0020620 | A1* | 1/2015 | Garner | A63B 21/0058 74/37 |

OTHER PUBLICATIONS

Motion Imaging and Analysis; "Motion Analysis Software for Biological and Veterinary Sciences (Equine and Canine Gait)", 2006, 2 pages, www.mi-as.com.

Adapted Physical Activity Quarterly, "Autism Research: The Effectiveness of Simulated Developmental Horse-Riding Program in Children with Autism", Apr. 2011, 2 pages, ultimateautismguide.com.

Duda, Marty, The Voice, "Equine-assisted therapy at addiction treatment center", 2007, 2 pages, www.hazeldon.org.

Sherman, Ben, "Horse therapy helps wounded Soldiers", Nov. 23, 2011, 2 pages, www.army.mil.

Cronk, Terri Moon, "Horse Therapy Helps Veterans Break Through PTSD", Apr. 5, 2012, 2 pages, www.defense.gov.

Brooks, Luisito, "Old Guard Soldiers, horses assist wounded warriors with therapeutic riding", Jun. 12, 2012, 2 pages, www.army.mil.

Samavati, Shaheen, "Exercise machine tries to simulate horseback riding", Jan. 9, 2008, 4 pages, blog.cleveland.com.

Harris, Hoyt, "How Horses are Helping U.S. Soldiers With P.T.S.D.", Nov. 11, 2010, 6 pages, www.katc.com.

Uchiyama, Hidehiko, Nobuyo Ohtani and Mitsuaki Ohta, "Three Dimensional Analysis of Horse and Human Gaits in Therapeutic Riding", Oct. 24, 2011, 5 pages, Applied Animal Behaviour Science.

Hammacher Schlemmer Exerciser, "The Compact Core Exerciser", Nov. 13, 2013, 1 page, Hammacher Schlemmer Exerciser.

Baylor University, "Advanced Mechanical Horse Built for Therapy", May 8, 2009, 7 pages, www.sciencedaily.com.

* cited by examiner

RELAXATION DEVICE AND METHOD OF USE

The present invention relates to a relaxation device and method of use, and, in particular, to a relaxation device and method of use by persons with autism spectrum disorders and other conditions.

BACKGROUND AND SUMMARY OF THE INVENTION

"Autism spectrum disorders" generally refers to a number of neurodevelopmental disorders. Asperger's Syndrome is one example of a condition that is typically considered an autism spectrum disorder. Persons with autism spectrum disorders often have difficulty communicating with others. In some instances, other symptoms or behaviors associated with autism spectrum disorders may include engaging in repetitive behaviors, exhibiting intense interest in certain subject matters, avoiding eye contact with others, not understanding personal space boundaries and difficulty understanding others' feelings.

In one embodiment of the present invention, a relaxation device includes a base, a support structure connected to the base, a seating portion and a drive mechanism located at least partially within the base and connected to the seating portion. The drive mechanism includes a housing connected to the support structure, a motor and drive system located at least partially within the housing, a support platform connected to the seating portion, first and second brackets having a first end coupled to the support platform and a second end coupled to the housing and first and second links having a first end coupled to the housing and a second end coupled to the support platform.

In certain embodiments of the invention, the motor and drive system includes an output shaft connected to the first end of the first link and the first end of the second link. The device may include a first shaft extending through the housing and having a first end extending through the first end of the first bracket and the second end of the first link and a second end extending through the first end of the first bracket and the second end of the second link. The device may further include a second shaft having a first end extending through the housing and the second end of the first bracket and a second end extending through the housing and the second end of the first bracket. The device may also include a third shaft extending through the housing and having a first end extending through the first end of the second bracket and a second end extending through the first end of the second bracket. In other embodiments of the invention, the device includes a fourth shaft having a first end extending through the housing and the second end of the second bracket and a second end extending through the housing and the second end of the second bracket.

In one embodiment of the invention, the support structure further includes first and second front legs and first and second rear legs. The device may further include a height adjustment mechanism having a worm gear, a follower coupled to the worm gear, a first drive link having a first end pivotally connected to the first front leg and a second end pivotally connected to the follower, a second drive link having a first end pivotally connected to the second front leg and a second end pivotally connected to the follower and an adjustment mechanism for moving the follower along the worm gear to extend and retract the first and second front legs and the first and second rear legs. The device may also include at least one wheel connected to at least one of the legs of the support structure.

In another embodiment of the invention, actuating the motor and drive system causes movement of the seating portion. The motor and drive system can cause the seating portion to move in a manner replicating the gait of a walking horse. A controller may be provided for controlling movement of the seating portion.

In another embodiment of the present invention, a relaxation device includes a base, a support structure connected to the base, a seating portion having an upper surface, a front right corner, a front left corner, a rear right corner and a rear left corner and a drive mechanism. The support structure is configured to support the device on a surface. The drive mechanism is located at least partially within the base and connected to the seating portion. The drive mechanism moves the seating portion in a cyclical pattern from a first orientation in which the upper surface is parallel with the surface on which the device is supported, forward to a second orientation in which the front right corner tilts downwardly, rearward to a third orientation in which the front right corner tilts upwardly and the rear left corner tilts downwardly, forward to a fourth orientation in which the front right corner and the front left corner tilt downwardly and the rear right corner and rear left corner tilt upwardly, rearward to a fifth orientation in which the left front corner tilts upwardly and the right rear corner tilts downwardly and back to the first orientation.

In one embodiment of the present invention, a method of relaxation for persons with autism spectrum disorders includes providing a device having a support structure, a base and a seating portion and moving the seating portion in a manner replicating the walking gait of a horse while a person is seated on the seating portion.

These and other features of the present invention will be apparent from the following description and the accompanying figures.

DETAILED DESCRIPTION OF EMBODIMENTS OF THE INVENTION

Figure 1:
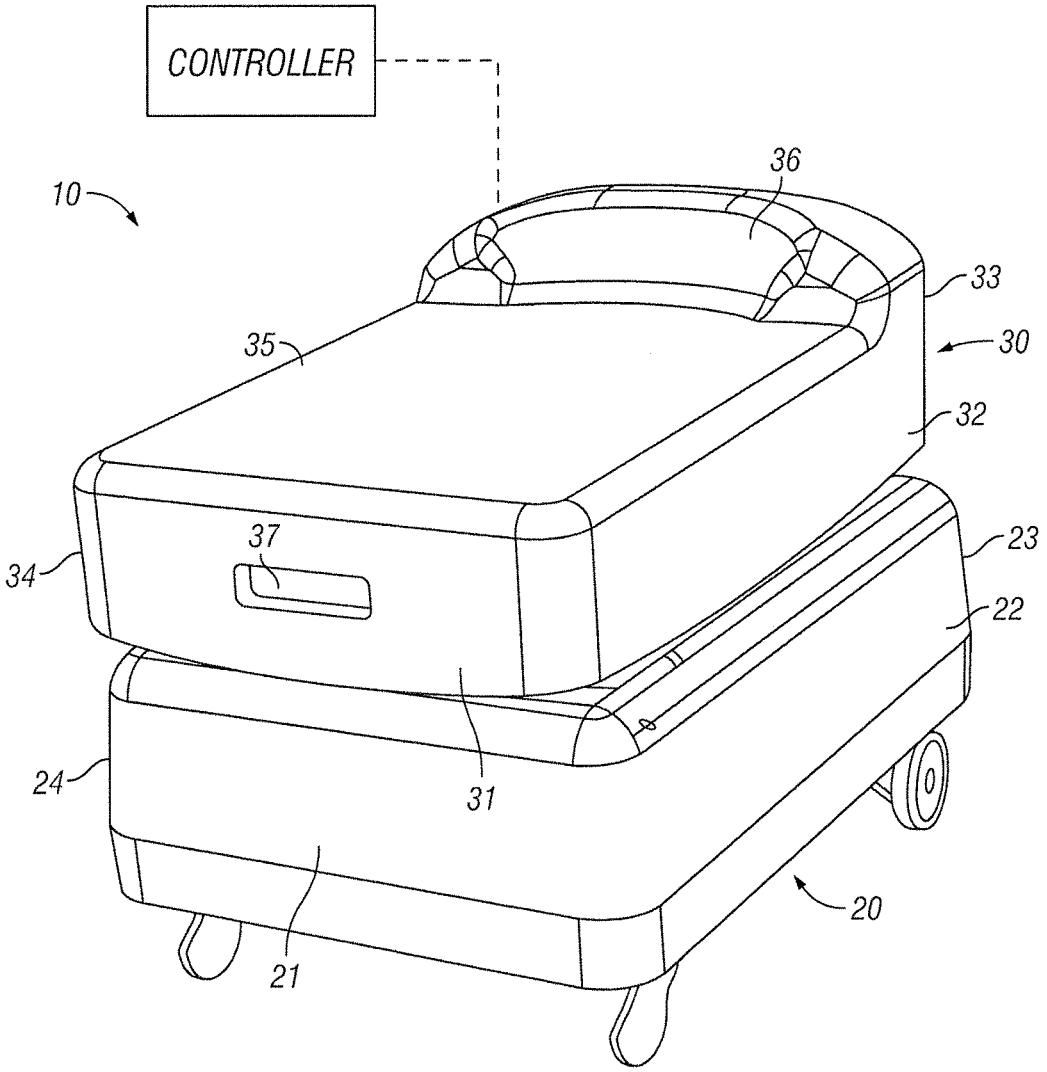
FIG. 1 is a perspective view of a relaxation device according to one embodiment of the present invention.
Figure 2:
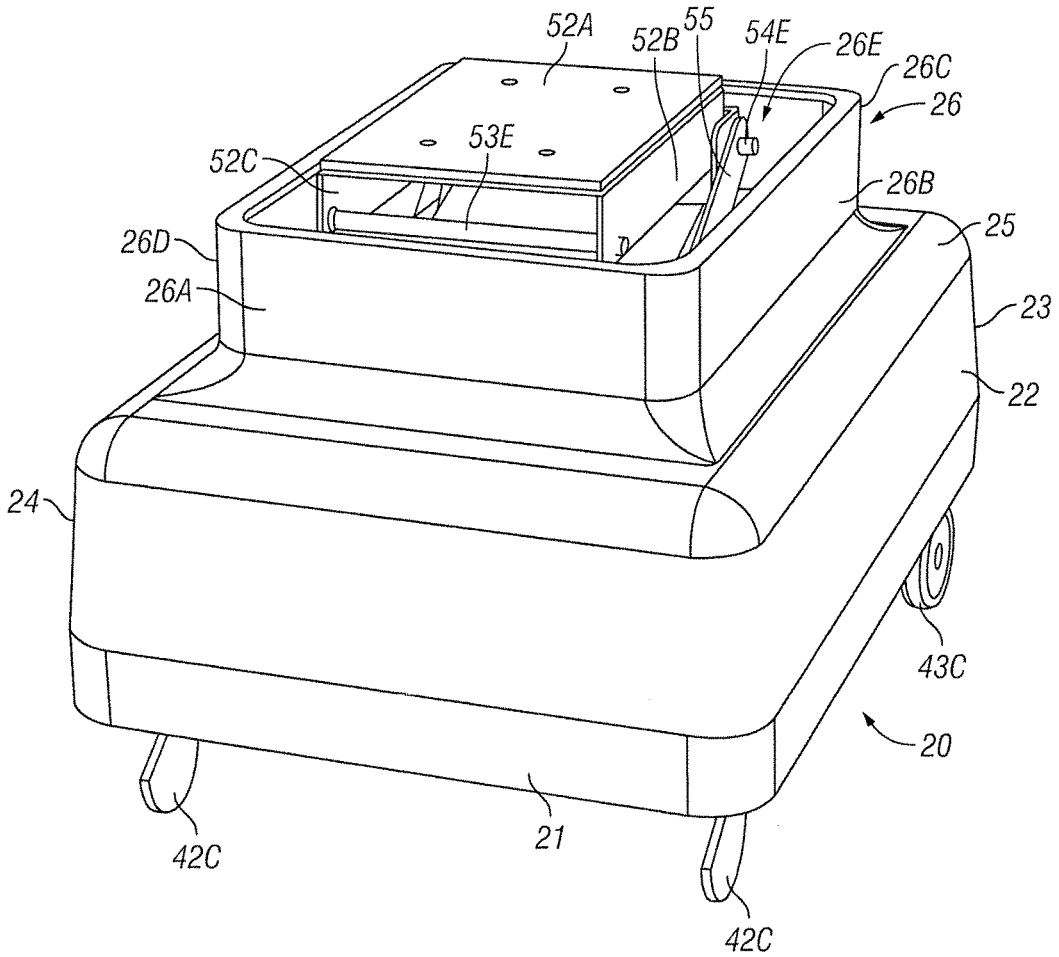
FIG. 2 is a perspective view of the device shown in FIG. 1 with the seating portion that is a component of the device removed.
Figure 3:
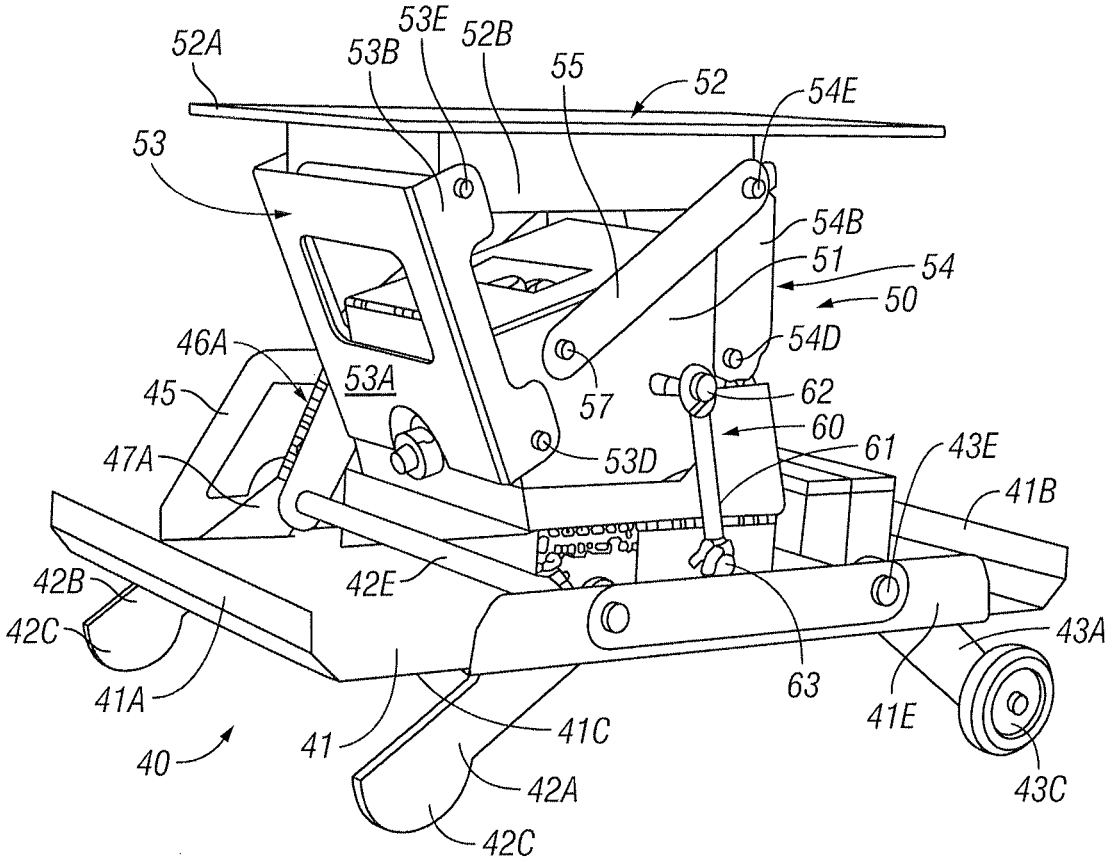
FIG. 3 is a front rear perspective view of a support structure and drive mechanism that is a component of the device shown in FIG. 1.

The present invention relates to a relaxation device and method of use. In one embodiment of the invention, the apparatus includes a device for simulating the walking gait (or motion) of a horse. Use of the device by a person with an autism spectrum disorder has a relaxing and soothing effect on the individual which reduces the behaviors associated with autism spectrum disorders.

In one embodiment of the invention, a relaxation device includes a seating portion on which the user may sit, a drive mechanism for moving the seating portion in a manner that causes the user to experience the motion and sensation of riding a horse and a controller for controlling the simulated gait produced by the drive mechanism.

Referring to FIGS. 1-4, a relaxation device 10 according to one embodiment of the present invention generally includes a base 20, a seating portion 30, a support structure 40 and a drive mechanism 50. In the embodiment shown, base 20 includes a first or front side 21, a second or left side 22, a third or rear side 23, a fourth or left side 24, a top or upper surface 25 and a transition section 26. Transition section 26 includes a first or front side 26A, a second or left side 26B, a third or rear side 26C and a fourth or right side 26D. Transition section 26 in the embodiment shown is narrower than the lower portion of base 20 and includes an opening 26E. Base 20 may be constructed from any suitably sturdy material to support the weight of the user as described below and may be covered with leather, upholstery and/or other materials. In one embodiment of the invention, base 20 is covered with a washable material.

Seating portion 30 generally includes a first or front side 31, a second or left side 32, a third or rear side 33, a fourth or right side 34, an upper or seating surface 35 and a support or back rest 36. In the embodiment shown, seating portion 30 further includes a handle 37. As with base 20, seating portion 30 may be covered with leather, upholstery or a washable fabric or material.

Base 20 is connected to support structure 40. Support structure 40 generally includes a base 41, a pair of front legs 42, a pair of rear legs 43 and a height adjustment mechanism. Base 41 includes a first or front upwardly turned end 41A, a second or rear upwardly turned end 41B, a third or left side 41C and a fourth or right side 41D. In the embodiment shown, left side 41C includes an upwardly extending flange 41E. Base 41 may support a power source, such a battery B.

Front legs 42 include a first or left side front leg 42A and a second or right side front leg 42B. Each of front legs 42*a* and 42B has a first end 42C and a second end 42D. A drive shaft or linkage 42E extends through legs 42A and 42B. Rear legs 43 include a first or left side rear leg 43A and a second or right side rear leg 43B. Each of rear legs 43A and 43B has a first end having a wheel or roller 43C and a second end 43D. A drive shaft or linkage 43E extends through legs 43A and 43B.

Figure 4:
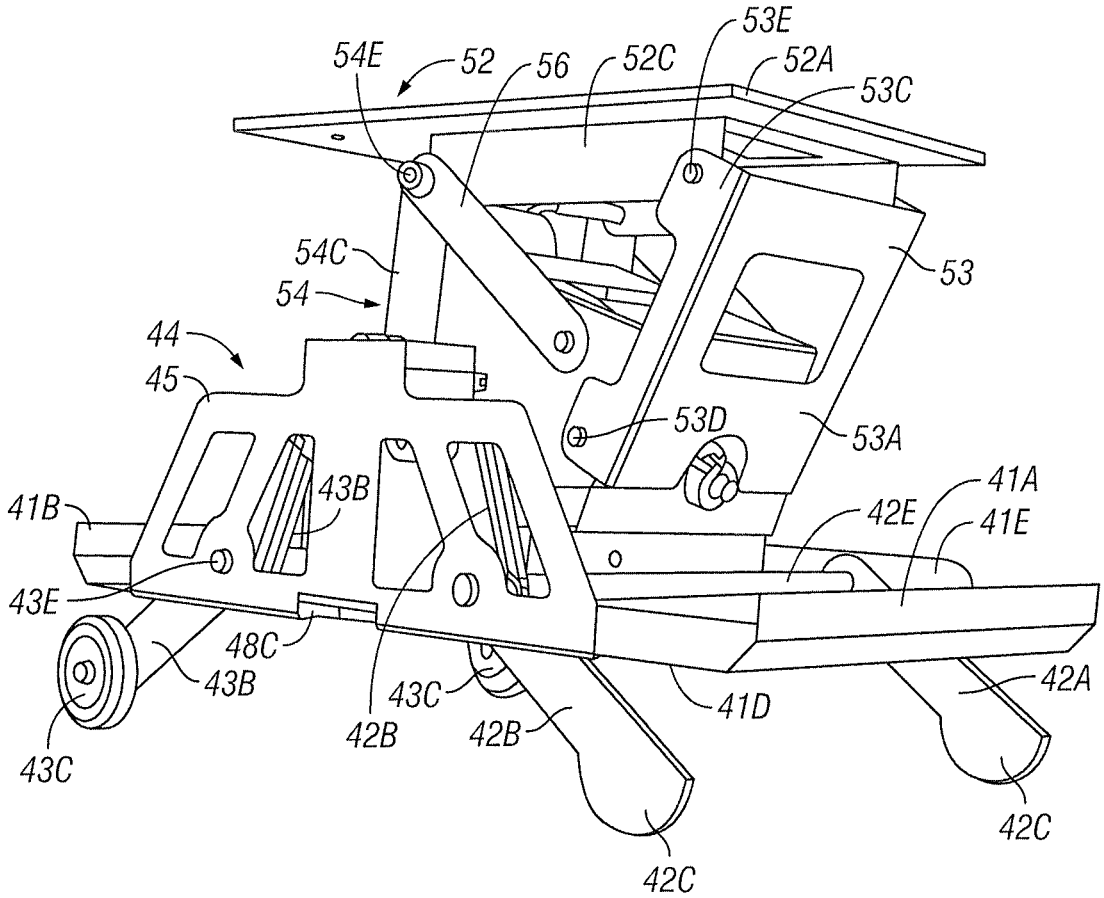
FIG. 4 is a left front perspective view of the support structure and drive mechanism shown in FIG. 3.
Figure 5A:
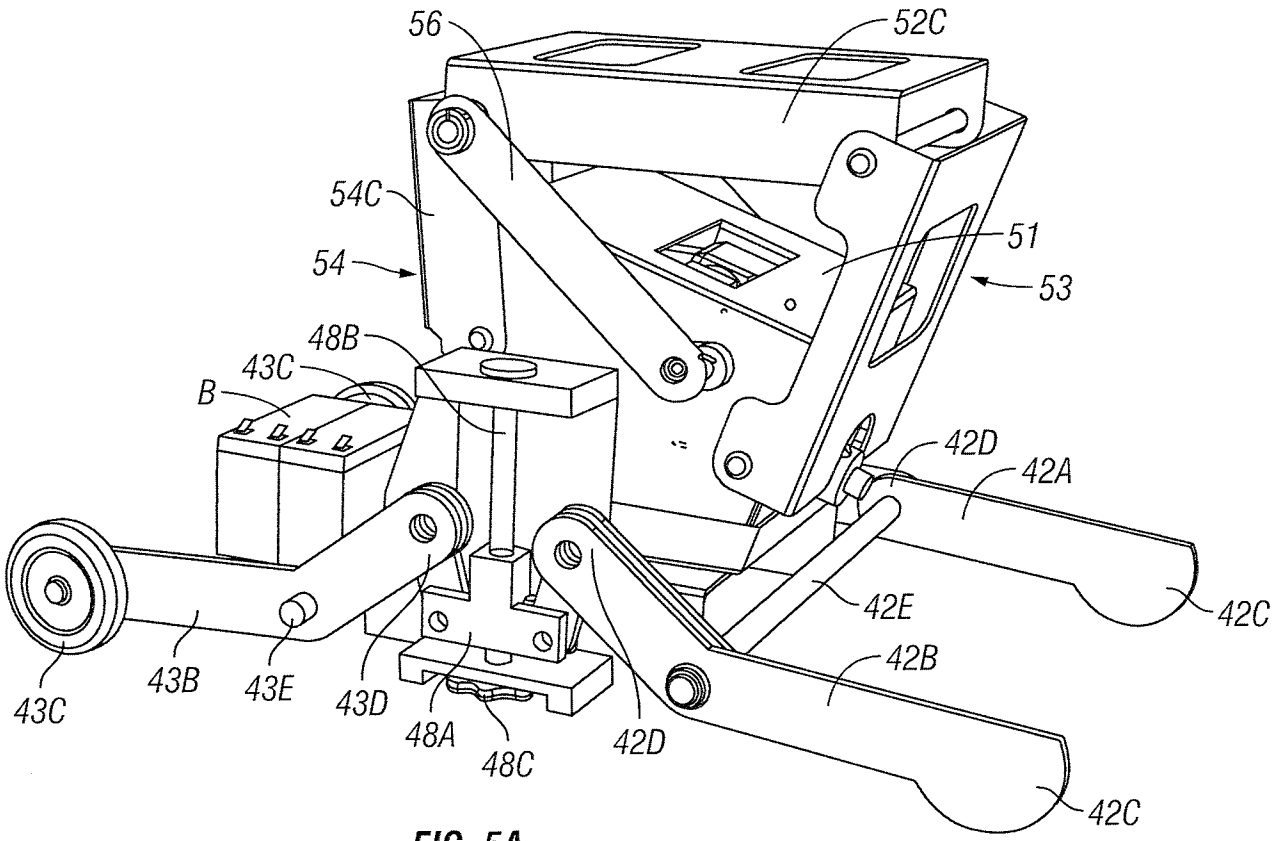
FIG. 5A is a detailed perspective view of components of the support structure shown in FIG. 3 in the retracted or stored position.
Figure 5B:
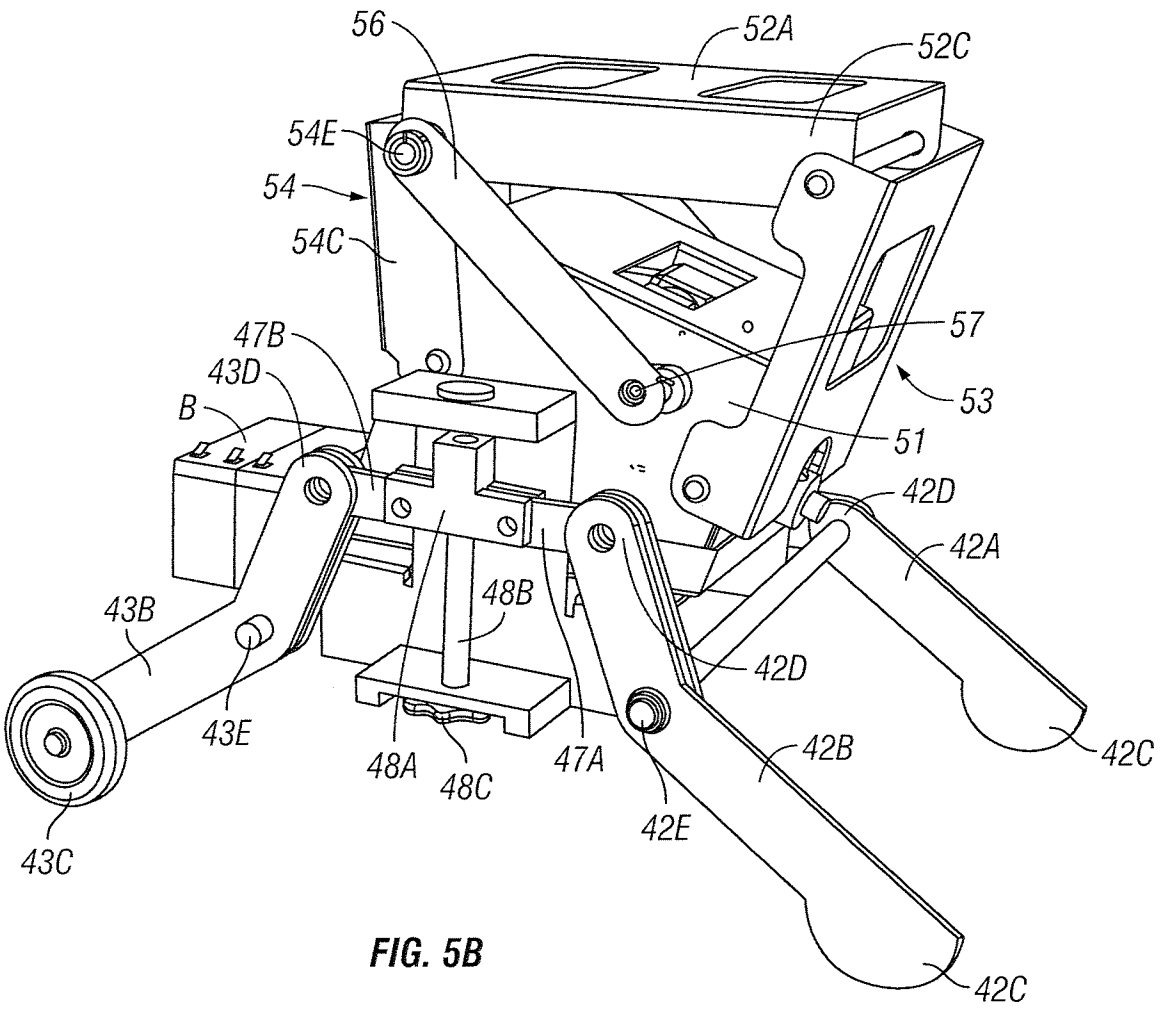
FIG. 5B is a detailed perspective view of components of the support structure shown in FIG. 3 in the extended position.

Referring to FIGS. 4, 5A and 5B, height adjustment mechanism 44 generally includes a bracket 45 (not shown in FIGS. 5A and 5B) connected to right side 41D of base 41, a first drive link 47A, a second drive link 47B, a follower 48A and a worm gear 48B. On the right side of support structure 40, second end 42D of front leg 42B is pivotally coupled to one end of first drive link 47A. One end of second drive link 47B is pivotally coupled to second end 43D of rear leg 43B. The opposite ends of drive links 47A and 47B are pivotally coupled to follower 48A. Follower 48A moves along vertically extending worm gear 48B as worm gear 48B rotates. An adjustment knob 48C may be used to rotate worm gear 48B, thereby driving follower 48A along worm gear 48B. In the position shown in FIG. 5A, front legs 42 and rear legs 43 are in the fully retracted position. In order to raise legs 42 and 43 to the position shown in FIG. 5B, adjustment knob 48C is rotated to drive follower 48A upward along worm gear 48B. As this occurs, the ends of drive links 47A and 47B attached to follower 48A are driven upwardly. This pulls second end 42D of front leg 42B and second end 43D of rear leg 43B upwardly. This causes legs 42 and 43 to rotate drive shafts 42E and 43E, driving legs 42 and 43 downward against a support surface and raising support structure 40, along with base 20 and seating portion 30. Regardless of the position of legs 42 and 43, handle 37 can be used to raise legs 43 off the ground and move device 10 on wheels 43C.

Drive mechanism 50 generally includes a housing 51, a support platform 52, a first or front bracket 53, a second or rear bracket 54 a left side link 55 and a right side link 56. Housing 51 is supported on base 40 and encloses a motor and drive system (not shown). The motor and drive system may include gears, drive shafts, cams and other components typically used to impart mechanical motion. The motor and drive system can be of any configuration that imparts motion to seating portion 30 as described below.

Support platform 52 generally includes an upper support plate 52A that is secured to the underside of seating surface 35, a first or left side flange 52B and a second or right side flange 52C. Flanges 52A and 52B extend downwardly and generally perpendicularly to support plate 52A. Bracket 53 includes a body portion 53A, a first or left side flange 53B and a second or right side flange 53C. Flanges 53B and 53C extend generally perpendicularly to body portion 53A. Flanges 53B and 53C are connected at their lower ends to a shaft 53D that extends through housing 51 and are connected at their upper ends to a shaft 53E that extends through flanges 52B and 52C. Bracket 54 includes a body portion 54A, a first or left side flange 54B and a second or right side flange 54C. Flanges 54B and 54C extend generally perpendicularly to body portion 54A. Flanges 54B and 54C are connected at their lower ends to a shaft 54D that extends through housing 51 and are connected at their upper ends to a shaft 54E that extends through flanges 52B and 52C.

The lower ends of links 55 and 56 are connected to the output shaft 57 of a drive motor housed within housing 51. The opposite ends of links 55 and 56 are connected to shaft 54E that extends through flanges 52B and 52C. Activating the motor and drive system imparts motion to links 55 and 56 through their lower ends and causes them to move in alternating back and forth motion over an arc segment to replicate the walking gait of a horse. The movement of links 55 and 56 imparts motion to support platform 52, bracket 53 and bracket 54, all of which pivot at their connection points to shafts 53D, 53E and 54E.

Device 10 may be provided with a controller (not shown) to control the motion characteristics produced by drive mechanism 50. For example, the controller can be used to set the simulated speed of a horse produced by drive mechanism 50. In certain embodiments of the invention, the controller is programmable such that it can simulate a ride in which the horse moves at a faster or slower gait or is moving uphill, downhill or across level terrain during different time periods. The controller may be mounted directly to base 20 or seating portion 30 or may be connected to one or both by wires. In other embodiments, the controller communicates with drive mechanism 50 through wireless technology.

Device 10 may be further provided with an adjustment mechanism 60 for aligning the components of drive mechanism 50. In the embodiment shown, adjustment mechanism 60 includes a turnbuckle 61 having a first end 62 connected to housing 51 and a second end 63 connected to support structure 40.

Figure 6:
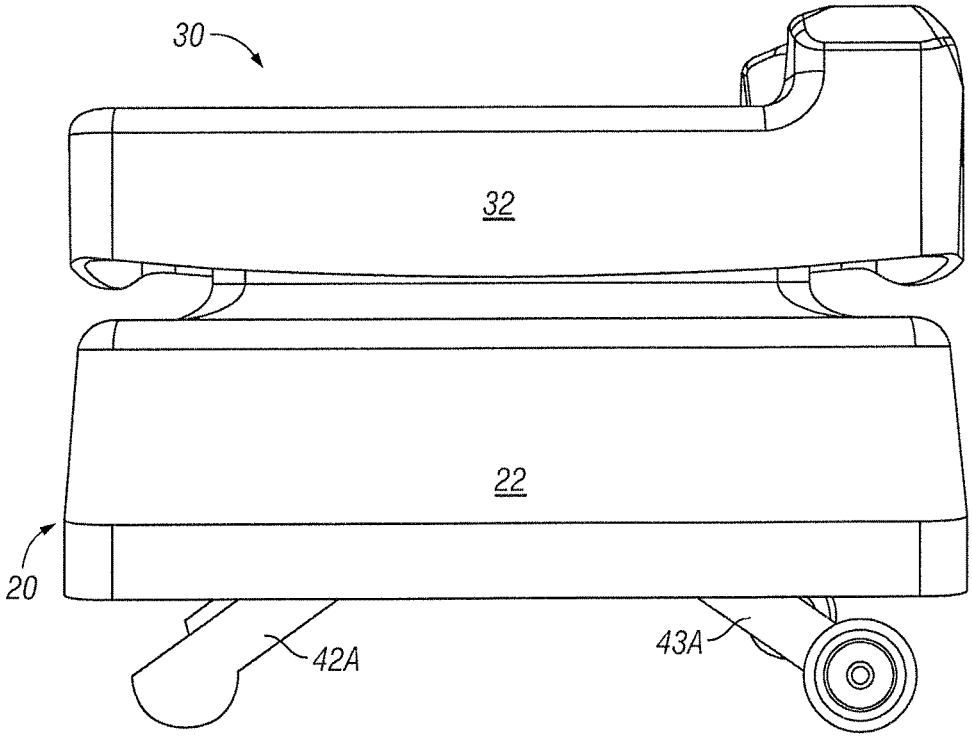
FIGS. 6-8 are left side plan views of the device shown in FIG. 1 illustrating the motion of the seating portion.
Figure 7:
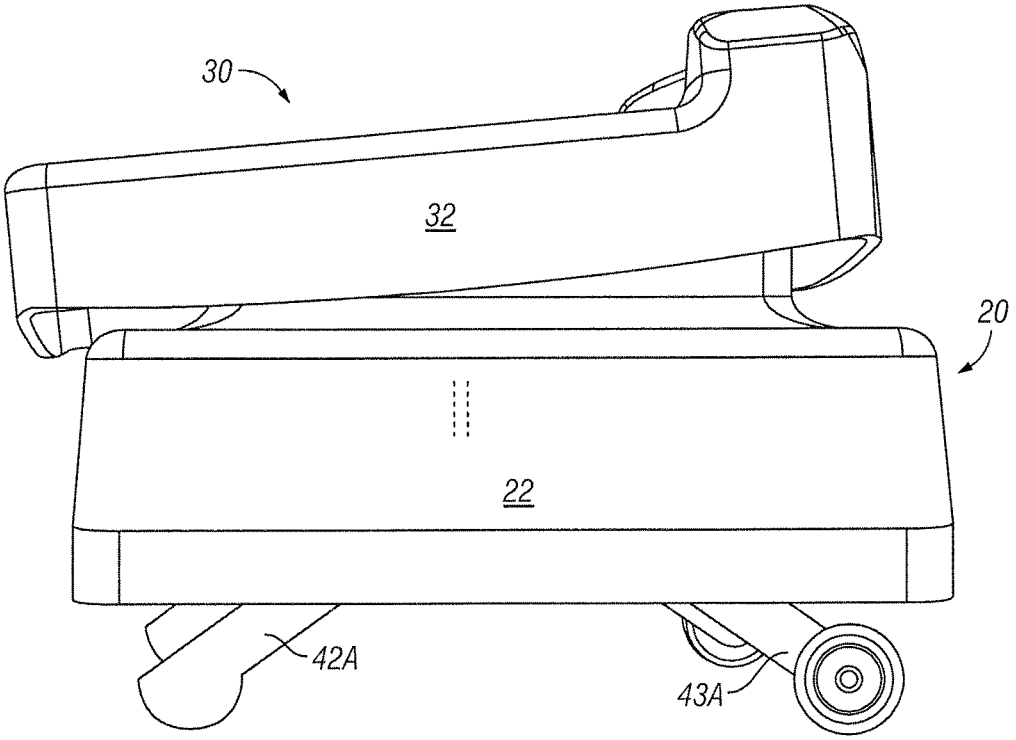
Figure 8:
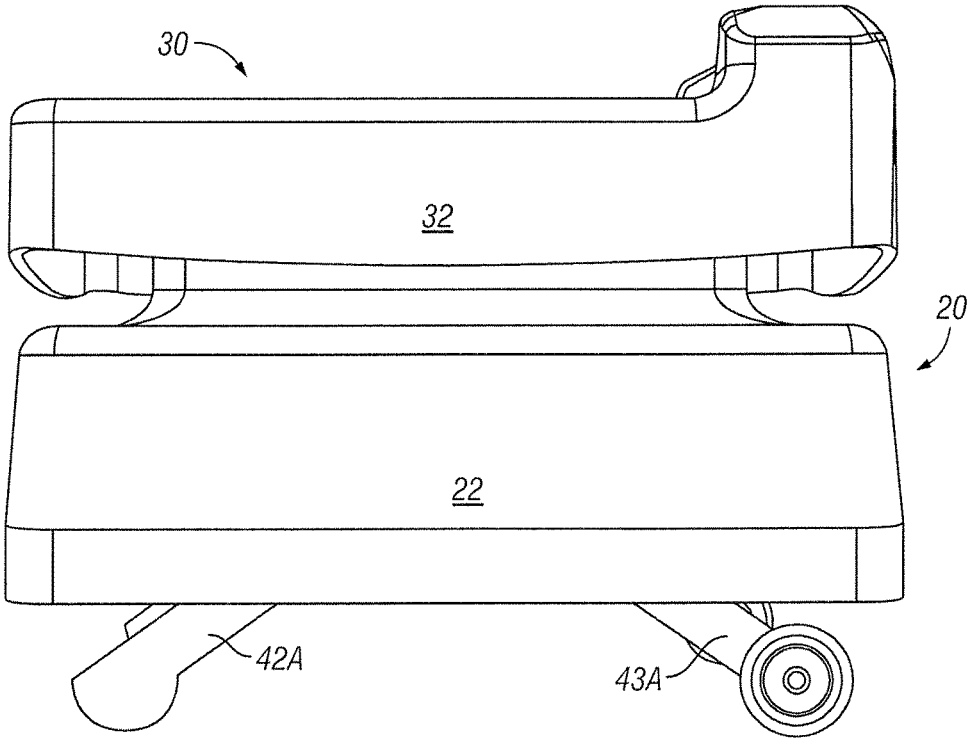
Figure 9:
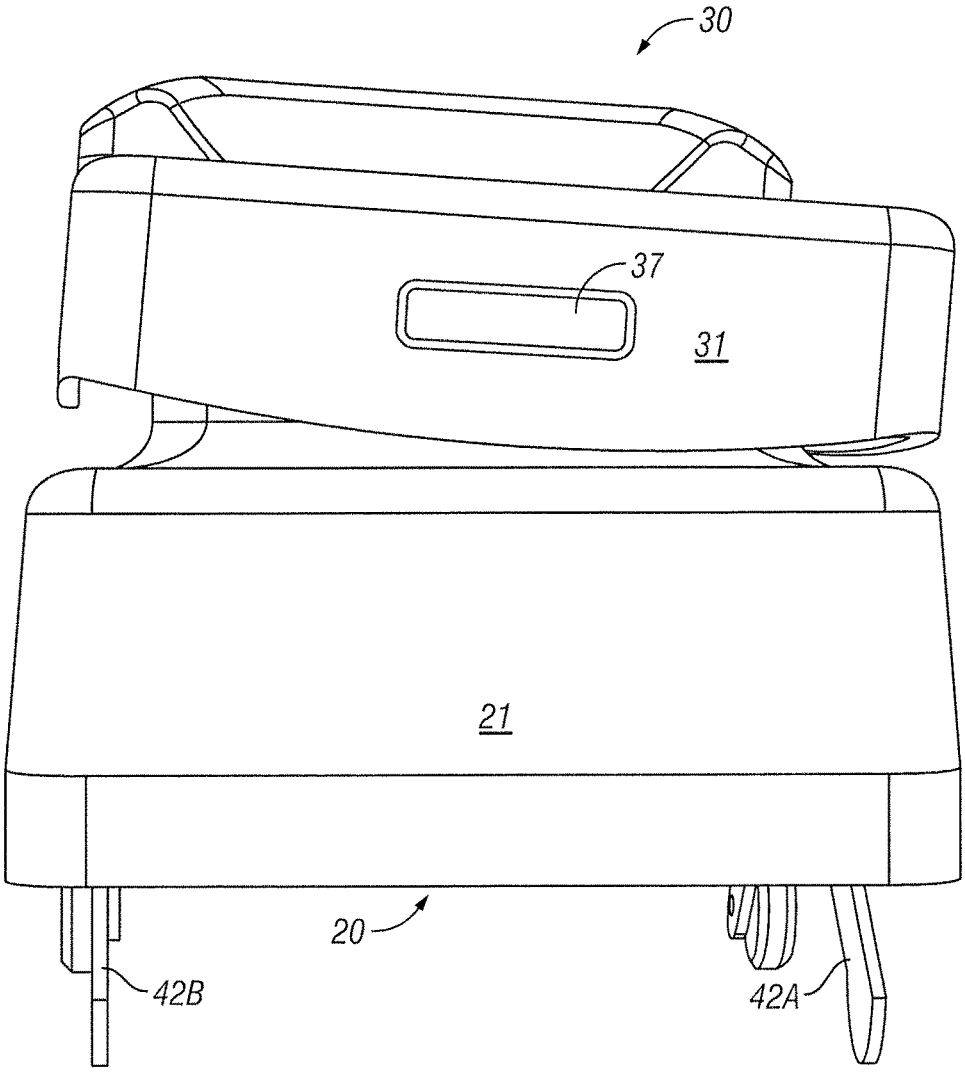
FIGS. 9-11 are front plan views of the device shown in FIG. 1 illustrating the motion of the seating portion.
Figure 10:
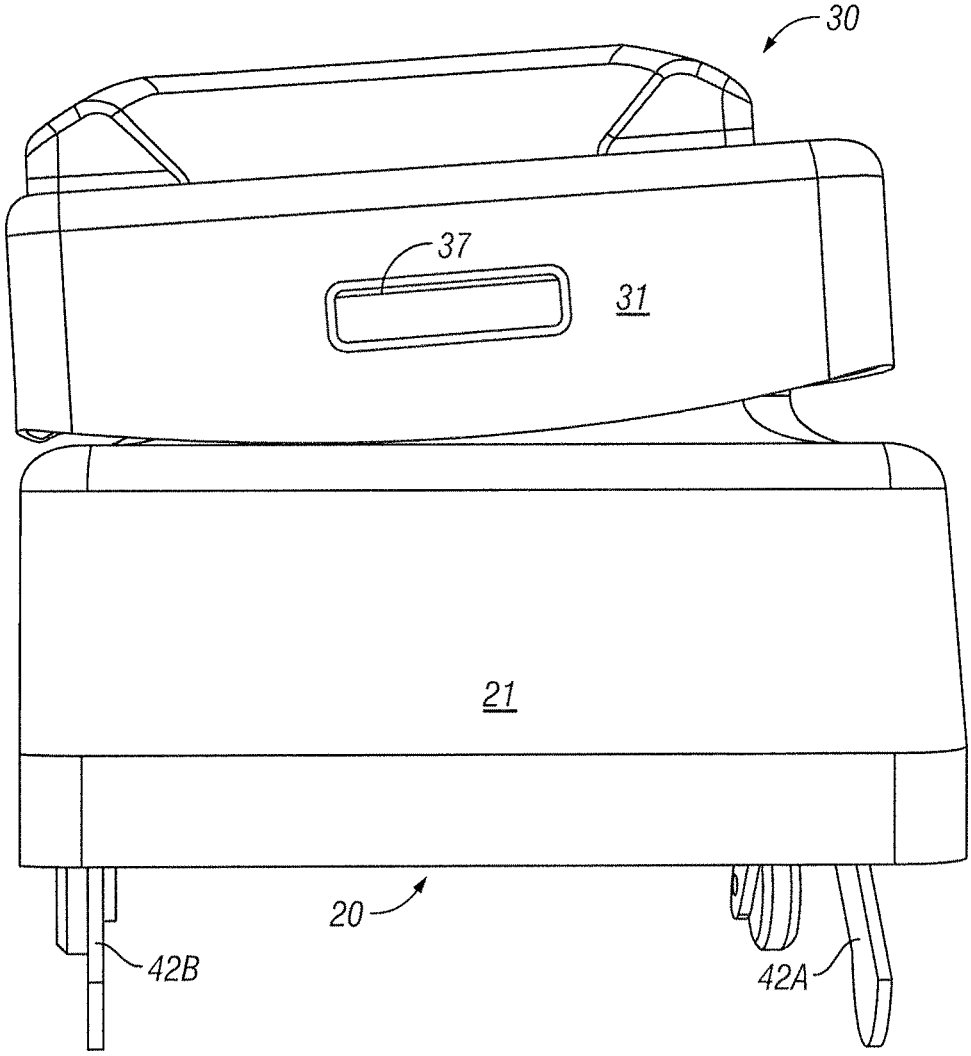
Figure 11:
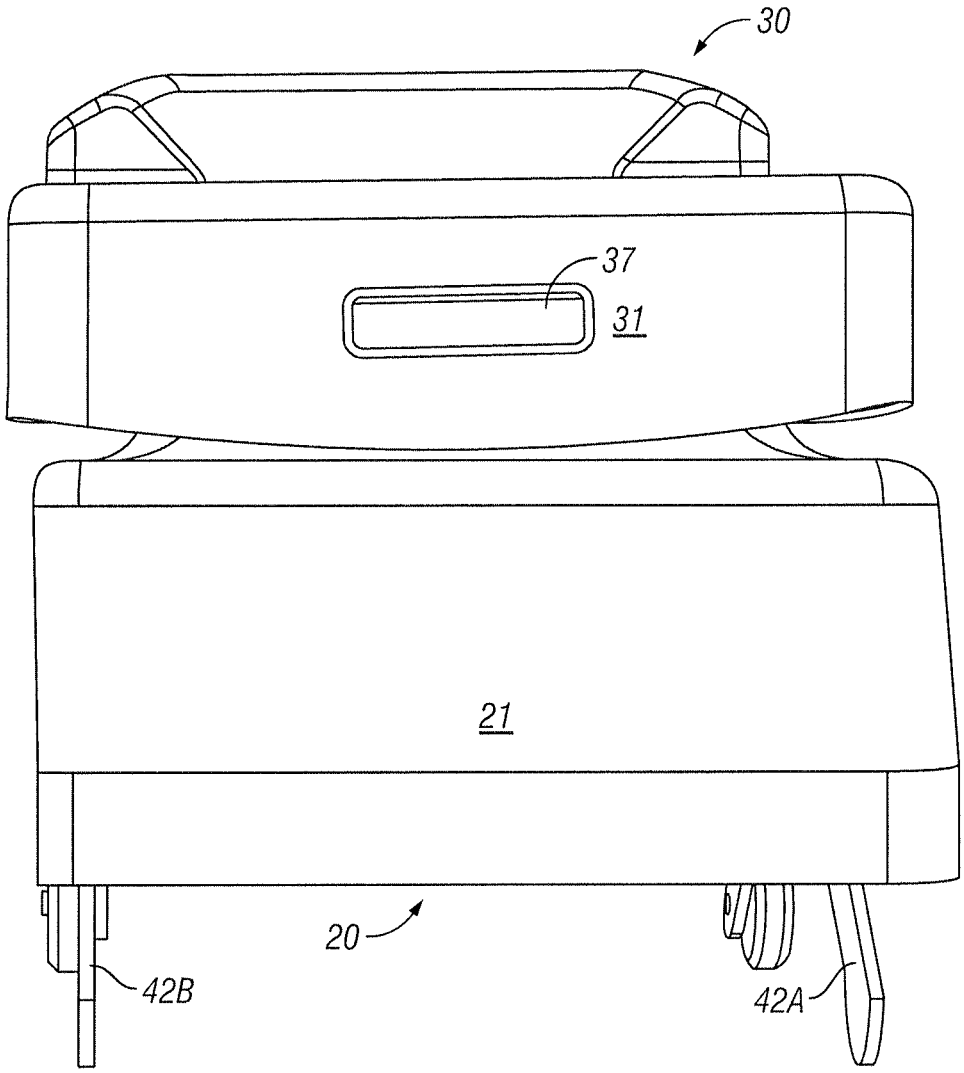

FIGS. 6-11 illustrate the motion of seating portion 30 according to one embodiment of the invention. FIGS. 6 and 11 show device 10 in its centered or neutral position. FIGS. 7, 8 and 10 show device 10 upon activation in which seating portion 30 has moved forward and to the right such that the front right corner tilts downwardly as shown in FIG. 8. As the seat moves backward, the front right corner tilts upwardly and the rear left corner tilts downwardly as shown in FIG. 9. In the next stage of movement, seating portion 30 moves forward with the front two corners tilting downwardly and the two rear corners tilting upwardly. Seating portion 30 then moves rearward such the left front corner tilts upwardly and the right rear corner tilts downwardly. The sequence is then repeated.

In certain embodiments of the invention, device 10 weighs from approximately 30 pounds to approximately 100 pounds. Device 10 may be designed to support persons of any weight.

In one embodiment of a method according to the present invention, an individual places the apparatus on a sufficiently supportive surface, uses the controller mechanism to set the desired ride characteristics (such as speed, time, changes in speed, terrain, etc.) and sits on the seating surface as the apparatus cycles through the programmed ride. The individual may use the apparatus one or more times a day as desired and for as long as desired. Use of the apparatus by the individual soothes and relaxes the individual, thereby reducing the propensity to exhibit the targeted undesired characteristics often associated with autism spectrum disorders.

Although the present invention has been described in detail the same is to be taken by way of example only and not by way of limitation. Numerous changes can be made to the embodiments described without departing from the scope of the invention.

What is claimed is:

1. A relaxation device, including:
- a base;
- a support structure connected to the base;
- a seating portion; and
- a drive mechanism located at least partially within the base and connected to the seating portion, the drive mechanism including:
  - a housing connected to the support structure;
  - a motor and drive system located at least partially within the housing;
  - a support platform connected to the seating portion;
  - a first bracket having a first end coupled to the support platform and a second end coupled to the housing;
  - a second bracket having a first end coupled to the support platform and a second end coupled to the housing;
  - a first link having a first end coupled to the housing and a second end coupled to the support platform;
  - a second link having a first end coupled to the housing and a second end coupled to the support platform; and
  - a first shaft extending through the support platform and having a first end extending through the first end of the first bracket and the second end of the first link and a second end extending through the first end of the first bracket and the second end of the second link.

2. The device according to claim 1, wherein the motor and drive system includes an output shaft connected to the first end of the first link and the first end of the second link.

3. The device according to claim 2, further including a second shaft having a first end extending through the housing and the second end of the first bracket and a second end extending through the housing and the second end of the first bracket.

4. The device according to claim 3, further including a third shaft extending through the support platform and having a first end extending through the first end of the second bracket and a second end extending through the first end of the second bracket.

5. The device according to claim 4, further including a fourth shaft having a first end extending through the housing and the second end of the second bracket and a second end extending through the housing and the second end of the second bracket.

6. The device according to claim 1, wherein the support structure further includes a first front leg, a second front leg, a first rear leg and a second rear leg.

7. The device according to claim 6, wherein the support structure further includes a height adjustment mechanism having a worm gear, a follower coupled to the worm gear, a first drive link having a first end pivotally connected to the second front leg and a second end pivotally connected to the follower, a second drive link having a first end pivotally connected to the second rear leg and a second end pivotally connected to the follower and an adjustment mechanism for moving the follower along the worm gear to extend and retract the first and second front legs and the first and second rear legs.

8. The device according to claim 6, further including at least one wheel connected to at least one of the legs of the support structure.

9. The device according to claim 1, wherein actuating the motor and drive system causes movement of the seating portion.

10. The device according to claim 1, wherein activating of the motor and drive system causes the seating portion to move in a manner replicating the gait of a walking horse.

11. The device according to claim 10, further including a controller for controlling movement of the seating portion.

* * * * *